US006066079A

United States Patent [19]

McDaniel

[11] Patent Number: 6,066,079

[45] Date of Patent: May 23, 2000

[54] ADJUSTABLE ROLLER TOOL

[76] Inventor: Michael McDaniel, 8831 Neil St., Thornton, Colo. 80221

[21] Appl. No.: 09/137,391

[22] Filed: Aug. 20, 1998

[51] Int. Cl.[7] ..... B23P 15/00

[52] U.S. Cl. ..... 492/13; 492/17; 492/19

[58] Field of Search ..... 492/13, 14, 19, 492/17; 15/230.11

[56] References Cited

U.S. PATENT DOCUMENTS 5,769,769 6/1998 Thorntore ..... 492/13

*Primary Examiner*—Irene Cuda

*Attorney, Agent, or Firm*—Ramon L. Pizarro; Edwin H. Crabtree

[57] ABSTRACT

A hand tool for squeezing or pressing down over an area with a roller. The tool includes a roller support structure with an elongate member having a first end, a mid-portion, and a second end, a roller support extending from the first end of the elongate member, a handle extending from the mid-portion of the elongate member, and a forearm engagement member. The handle will preferably be detachable from the roller support structure. A roller support frame with a substantially horizontal member and a roller support axis, and an adjustable connection that allows the user to selectively retaining the horizontal member against the roller support member at a desired angle to the roller support member, so that the angle of the roller support axis relative to the roller support member may be varied. Additionally, the removable handle is adapted for direct attachment to the roller support frame to allow use of the roller support frame together with the handle and without the roller support structure.

16 Claims, 4 Drawing Sheets

ADJUSTABLE ROLLER TOOL

BACKGROUND OF THE INVENTION (a) Field of the Invention

This invention generally relates to a device for supporting a hand roller, and more specifically, but not by way of limitation, to an adjustable support for a roller, the support cradling the user's forearm and allowing this user to vary the angle between the roller and the user's hand and forearm.

(b) Discussion of Known Art

Many of today's roofs are covered with a polymer sheet which prevents water and other elements from entering the structure protected by the roof. Unfortunately however, the installation of this roofing material cars application of heat and pressure to ensure that laminates from the polymer used to cover the roof are properly secured in to one another to produce a water tight seal between the layers of polymer material. In the construction industry it is common to use a small hand held roller, such as the roller shown in Australian Patent 183,9442 apply pressure over the seams of the laminate being pressed or squeezed together with the aid of heat.

To squeeze or press together the sheets of laminate, the user must apply a great deal of force on the handle of the roller to squeeze or bear down on the scene of the sheets of material being bonded to one another. When dealing with trick layers or sheets of material, the force which must be applied by the roofing installer can quickly wear down or fatigue even the fittest individual. This means that the job must be rotated amongst several people, or sufficient time must be allowed so that the installer can recover. Moreover, the pressure that must be delivered through the roller is transmitted directly through the wrist as a large bending moment on the wrist. This kind of stress on the wrist leads to a quick deterioration of the cartilage material and lead to ailments such as carpal tunnel syndrome, as well as other ailments.

Thus, there remains a need for a roller tool which allows efficient transfer of a force delivered by a user to the roller. Importantly, there remains a need for a tool that allows a user to transfer his body weight to the roller without placing significant bending moments on the wrist of the user.

Many hand tools use a handle to allow the user to deliver a force which in turn is used to carry out or perform some sort of work. For example, in the case of a paint roller, the handle is used to allow user to position the head of the roller over the area to be painted, and then to exert the desired force on the roller to achieve desired rolling motion over the area to be painted. For example, in U.S. Pat. No. 4,528,714 to Beck a paint roller together with an adjustable means located along a component of the paint roller frame is used to allow the user to assert a force on the roller and vary the angle of the roller relative to the handle. While the Beck device is particularly advantageous for uses where different angled areas are to be painted, it does not allow the user to place a significant amount force on the roller. This limitation does not result in a significant disadvantage in the area of painting surfaces, but it is of little value in terms of a suggestion or direction for other hand tools. Importantly, the Beck device gives little clue as to how to deliver a large force to the roller without transmitting a large torque or bending moment through the user's wrist.

Other roller devices give little clue as to how to alleviate the problems associated with the need to deliver or transfer a great deal force to a hand-held roller. For example, U.S. Pat. No. 1,461,815 to Bird and by U.S. Pat. No. 563,044 to Lewis teach the use of a handle that is added angled to the roller of the handle allowing the user to align his forearm with the roller, while leaving the wrist closer to a natural, unstressed position relative to the forearm. Unfortunately, however, both of these devices require that the stability of the entire tool depend on the forces applied directly at the handle. This believes the work of stabilizing the tool to be carried out entirely by the wrist, leaving the wrist susceptible to problems associated with introducing bending moments through the wrist.

The problems associated with over loading the risk while bearing down on a handled tool have been recognized in the field of scraping tools. Most of these tools alleviate the loads on the wrist by providing a forearm brace. For example, in U.S. Pat. No. 4,888,846 to Natale a scraping tool with a frame with a handle that is at a traverse position relative to the frame and with a forearm brace is taught. The problems associated with providing a force on a scraper's edge are significantly different from the problems associated with providing a force that bears down on a roller. An important difference between the problems associated with scrapers as compared to rollers is that when a force is used to drive a scraper into the material to be scraped, the edge of the scraper bites into and reacts against the force without having a tendency to move away or slip away out of the direction of the force.

Accordingly, scraping tools have component set allow the user of the scraping tool to deliver a force onto the edge of scraping tool without much concern about countering bending moments introduced by the need to overcome the tendency of the head is tool to slip away, as is encountered in tools with a roller at the working tip or head.

Scraping tools such as the scraper taught in U.S. Pat. No. 4,962,561 to Hamilton, U.S. Pat. No. 5,455,981 to Wiese, and U.S. Pat. No. 5,471,700 to Pereira, approach the use of forearm support: and handle a forearm support to allow delivery of force directly into the blade of the scraper, but little by way of suggestion or teaching as to how to allow a user to deliver the large amount force through the handle or gripping portion tool to a roller, with a roller is to be used to squeeze or press against materials over different contours and different angled directions of travel.

It lightly above the can be appreciated that the remains in need for a roller tool that alleviates the bending moments on the user's wrist.

Moreover there remains a need allows user to use his weight to bear down on a roller used to squeeze or press layers of material together.

Still further remains need for a roller tool allows the user to adjust, with precision, the angle of the roller relative to the user forearm and wrist.

SUMMARY

It has been discovered that the problems left unanswered by known art can be solved by providing a support structure for a roller tool to be held by hand, the support structure includes:

a) an arm support frame having an elongate member that extends substantially parallel to the user'arm and a forearm support;

b) a roller support frame attached to a roller support that extends from the elongate member, the roller support frame being attached to the roller support through an adjustable connection that allows the user to vary the angle of the roller support frame relative to the roller support; and c) a handle that is substantially parallel to the roller support, the handle being substantially parallel to the roller support.

According to a highly preferred embodiment of the invention the elongate member includes a first end, a mid-portion, and a second end. In this embodiment the roller support extends from the first end of the elongate member and at a substantially right angle to said elongate member. Additionally, in this embodiment, the handle extends from the mid-portion of the elongate member at a substantially right angle to the elongate member. Extending from the second end of the elongate member is a forearm engagement member which extends at a substantially right angle to the elongate member.

In order to allow efficient, and stable transfer of forces to be delivered through the roller, a separate roller support frame having a substantially horizontal member and a roller support axis, the horizontal member is substantially parallel the roller support axis. In a highly preferred embodiment of the invention an adjustable connection which allows the user to vary the angle of the roller support frame is used as a means for selectively retaining the horizontal member of the roller support frame against the roller support member. It has been discovered that by allowing the user to vary the angle of the roller support frame relative to the support frame, which includes the handle and forearm support, one allows the user to adjust the tool to accommodate the natural position of his skeletal structure while using the tool to squeeze or compress materials.

Importantly, it has been discovered that to allow the user to work for longer periods of time, it is advantageous to allow the position of the roller relative to the support structure. This, in turn, allows the user to maintain substantially the same body position relative to an area to worked with the roller while varying the muscles and used to work the area. For example, an individual kneeling next to a surface to be pressed with the roller may set the roller support frame to allow him to hold the handle with his wrist and knuckles substantially parallel to his shoulders while moving the roller along a line normal to his shoulders. This arrangement and motion emphasizes the use of the lower deltoid muscles. Once he tires of this arrangement, he may then pivot the roller support frame relative to the roller support and handle, so that he may move the roller along the same line while his wrist and knuckles at an angle to his shoulders, and emphasize the use of the upper deltoid muscles.

Thus, it will be appreciated that the disclosed invention offers advantages in comfort during use.

Moreover, it will be appreciated that the disclosed invention allows the use of a forearm support structure that allows the user to react any bending moments produced by the pressing/rolling action between the forearm and wrist instead of reacting the entire bending moment through the wrist.

According to another highly preferred embodiment of the invention, the handle of the tool is adapted for mounting against the frame and for separating the handle form the frame and allowing the roller support frame to mount directly to the handle, and thus allowing the user to convert the tool to a conventional roller from a roller with a forearm support frame.

It should also be understood that while the above and other advantages and results of the present invention will become apparent to those skilled in the art from the following detailed description and accompanying drawings, showing the contemplated novel construction, combinations and elements as herein described, and more particularly defined by the appended claims. It should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
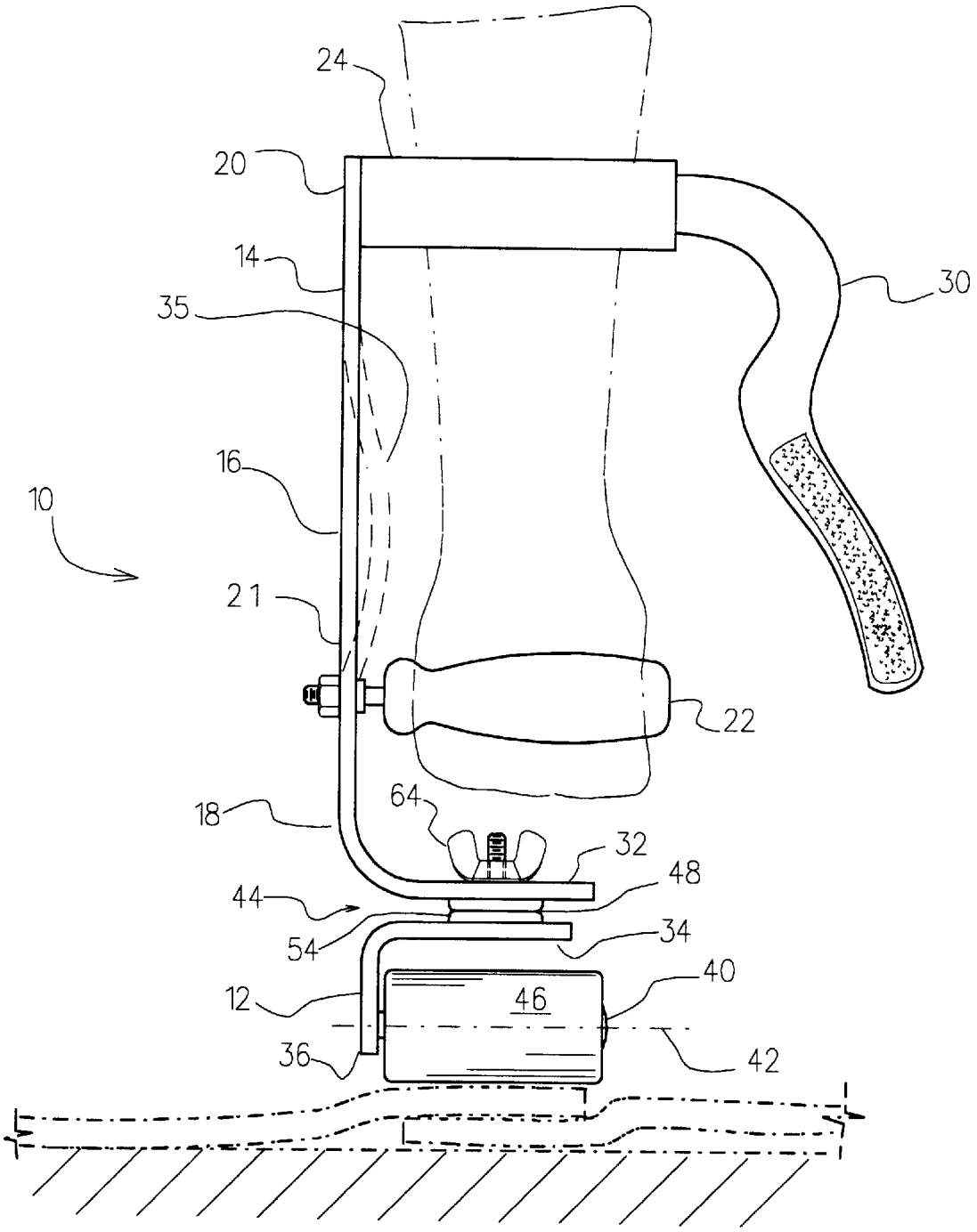
FIG. 1 is a front elevational view illustrating the placement of a user's arm in the invention.

Turning now to FIG. 1 where an adjustable roller tool 10 has been illustrated while in use. The adjustable roller tool has been shown including a roller support frame 12 which is mounted on a roller support structure 14. A highly preferred embodiment of the roller support structure 14 includes an elongate member 16 which includes a first end 18, a mid-portion 21, and a second end 20. As shown on FIG. 1 it is preferred that the mid portion 21 of the roller support structure 14 be bendable, and thus allowing the user the bend and adjust the roller support structure 14 as indicated by dashed lines 35 to accommodate a particular user's anatomy.

Figure 2:
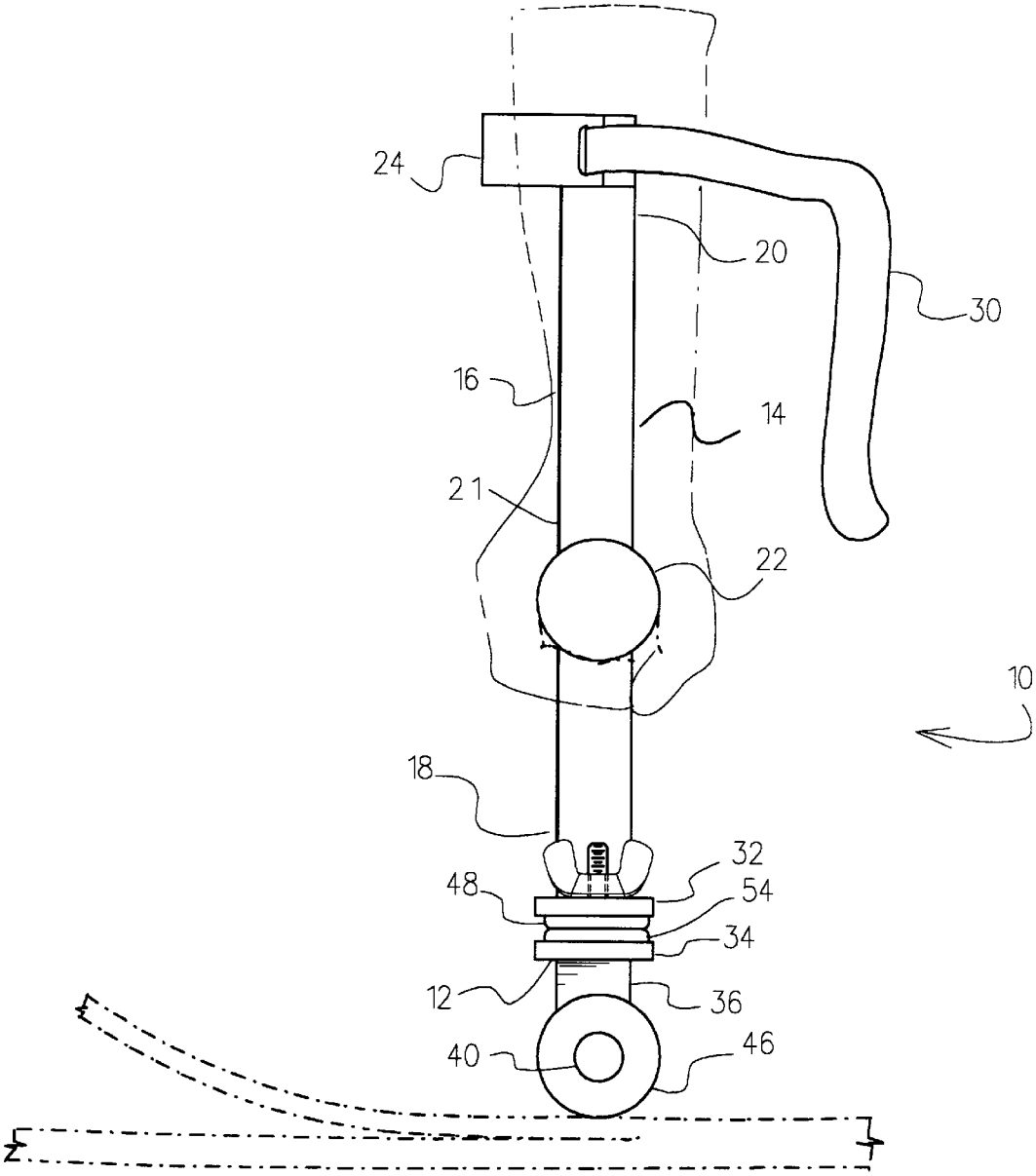
FIG. 2 is a side elevational view of the invention while the invention is being used to press two sheets of material together.

As illustrated in FIGS. 1 and 2, a highly preferred embodiment of the invention includes an elongated handle 22 which extends from the mid-portion 21 of the elongate member 16. It is contemplated that the handle 22 will be mounted at a substantially right angle to the elongate member 16. In addition to the elongate handle 22, it is contemplated that forearm engagement member, or support, 24 will be attached to the elongate member 16 at a substantially right angle to the elongate member at the second end of the elongate member 16. The forearm engagement member 24 will preferably extend from the second end of the elongate member 16 at a substantially right angle to the elongate member 16.

As can be understood from FIGS. 1 and 2, the forearm engagement member 24 will include a generally arcuate section 26 adapted for accepting the user's forearm 28. In a highly preferred embodiment of the invention a strap means 30 is used to retain the user's forearm 28 against the arcuate section 26. In a highly preferred embodiment of the invention, these strap means 30 include sections of hook and loop material to allow precise adjustment of the strap means 30 about the user's forearm.

Referring once again to FIG. 1 it can be seen that a roller support member 32 will preferably extend from the first end 18 of the elongate member 16. The roller support frame 12 attaches to the roller support member 32 through a means for selectively positioning the roller support frame against the roller support member 32.

The roller support frame 12 will preferably include a substantially horizontal member 34 and at least one substantially vertical member 36. Attached to the substantially vertical member 36 is a means for supporting a roller wheel 38, which in a highly preferred embodiment consists of an axle 40 extending along a roller support axis 42. Thus, the preferred arrangement will result in the roller support axis 42 being substantially parallel to the substantially horizontal member 34 of the roller support 32.

The roller support structure 14 will preferably be supported against the roller support frame 12 by a means 44 for selectively positioning the roller support structure 14 against the substantially horizontal member 34 of the roller support structure 14. In a highly preferred embodiment of the invention the substantially horizontal member 34 of the roller support structure 14 will be held directly over, and at an angle, to the roller support 32 of the roller support frame 12.

Figure 3:
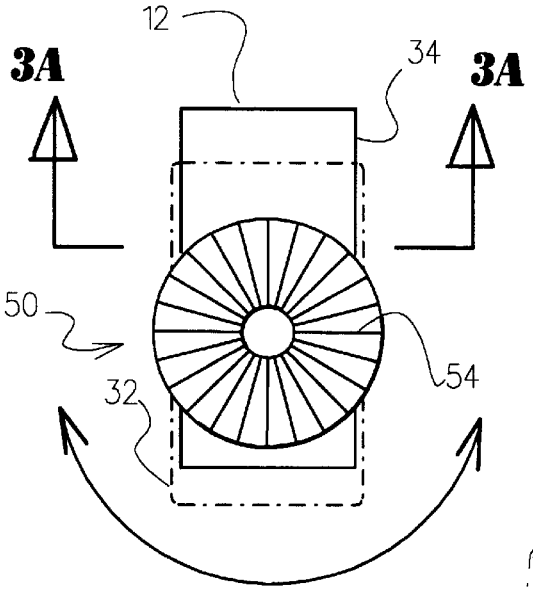
FIG. 3 is a top, plan view of the preferred adjustment means used with the invention.

It will be understood from FIGS. 1–3 that the position of the roller support 32 relative to the handle 22 is important in allowing proper transfer of forces introduced by the user through the handle 22 to the axle 40 and the roller wheel 46 used with the invention. Importantly, the configuration of the instant invention allows the user to lean on the handle 22 to take advantage of the user's weight in squeezing or rolling over materials with the instant invention. Thus, it will be understood that the instant invention will be particularly useful for rolling and compressing thick laminates and the like.

When rolling or squeezing materials together by hand one needs to deliver a large force to a concentrated area directly below the roller 46. Often, the area being squeezed together follows irregular paths or contours. Therefore, the tool used to squeeze the laminates together needs to allow the user to transfer a large force through the roller wheel 46 while following various contours and patterns. By providing a means for adjusting the angle of the roller wheel 46 relative to the handle 22, while at the same time allowing the user to use his weight to bear down on the roller and laminates by leaning on the handle 22, it has been discovered that one allows the user to adjust the tool to compensate for variations of the contours of the surface being squeezed or pressed, while accommodating the user's anatomy to allow more effective transfer of the user's weight or force to the roller and reducing the fatigue to the user.

Figure 3A:
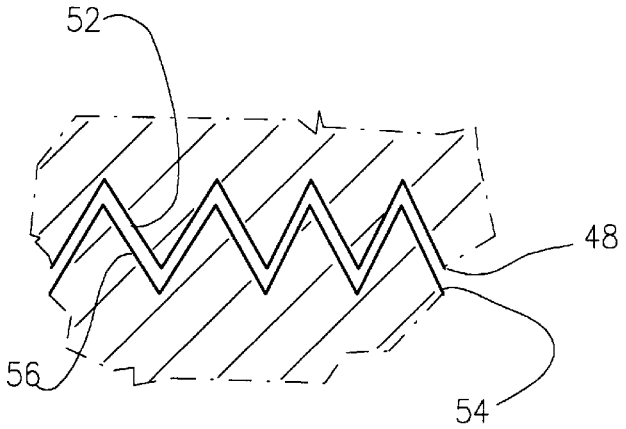
FIG. 3A is a section taken as indicated from FIG. 3, looking in the direction indicated by the section arrows.
Figure 4:
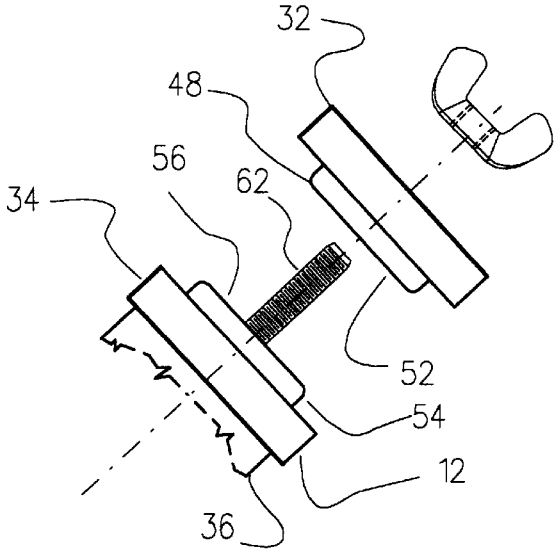
FIG. 4 is an exploded view of the adjustment means shown on FIG. 3.

In a highly preferred embodiment of the invention, illustrated on FIGS. 3, 3A, and 4, the means 44 for selectively adjusting the position of the roller support structure 14 relative to the roller support frame 12 includes a first surface 48, which includes an engagement means 50. In a highly preferred embodiment of the invention, the first surface 48 is mounted along the roller support 32, and the engagement means 50 include a plurality of radially extending protrusions 52. Mounted along the substantially horizontal member 34 is a second surface 54 with radially extending recesses 56 for cooperating with the protrusions 52 on the first surface 48. Additionally, the means 44 for selectively positioning the roller support structure 14 includes means to secure 58 an orientation of the means 44 for selectively retaining the first surface 48 against the second surface 54. According to a highly preferred embodiment of the invention, these means to secure 58 include a bolt or other fastener and a mating wing nut or the like, as well as any other known fastening means.

Figure 5:
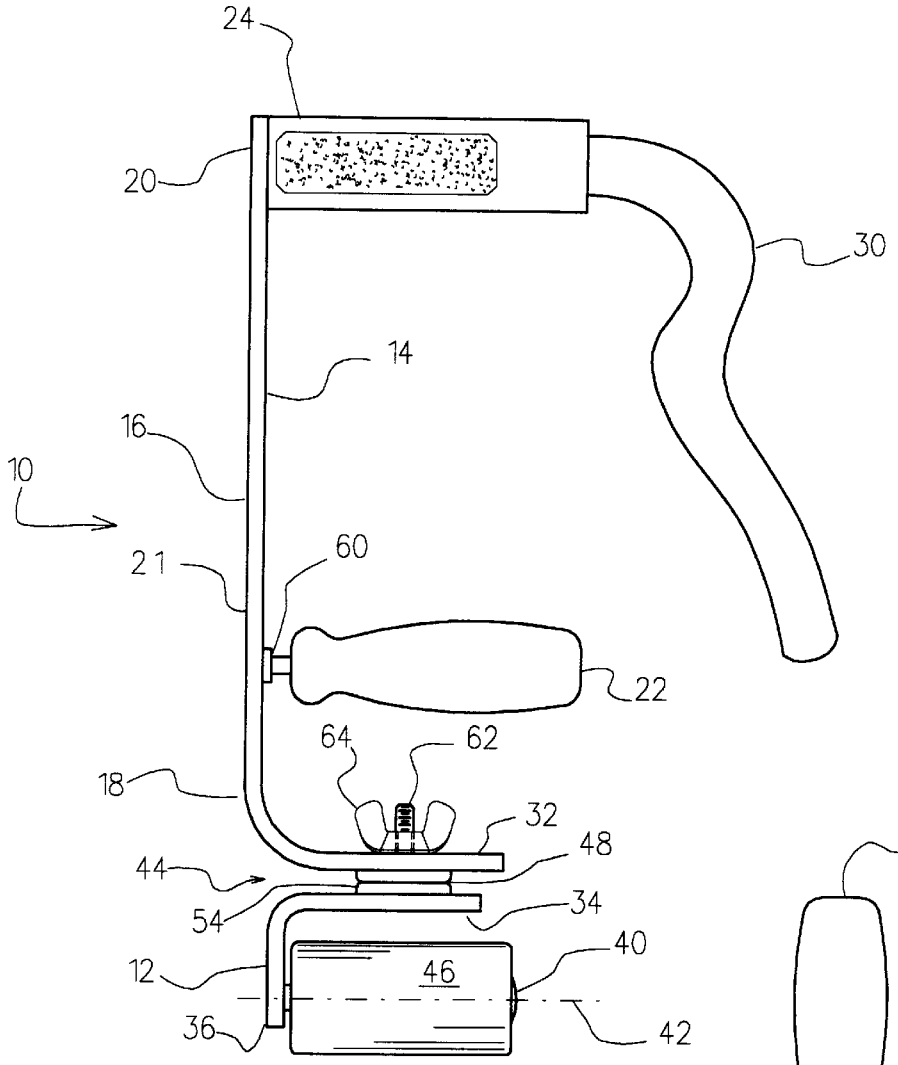
FIG. 5 is a front elevational view of a highly preferred embodiment of the invention, the embodiment allowing the separation of the handle from the frame used to accept the forearm and the mounting of the roller support frame directly to the handle.
Figure 6:
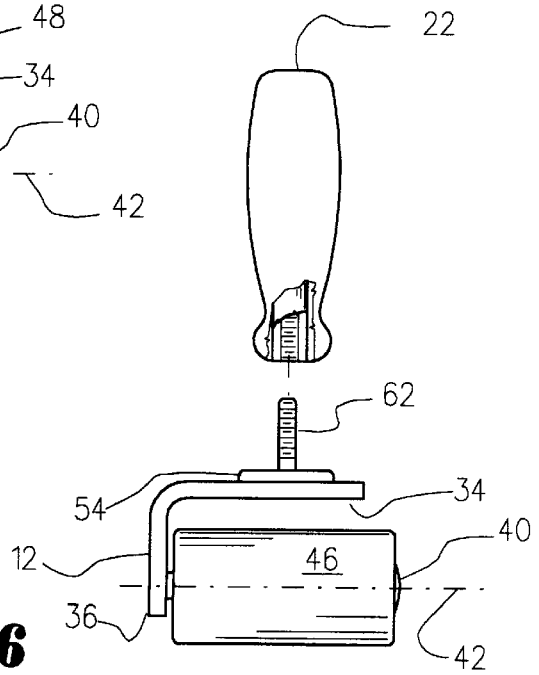
FIG. 6 is a front elevational view illustrating the mating of the handle and the roller support frame.

Turning now to FIGS. 5 and 6 where a highly preferred embodiment of the invention has been illustrated. The embodiment shown on FIGS. 5 and 6 allows the separation of the handle 22 from the support structure 14 by incorporating a releasable support means 60 at the mid portion 21 of the elongate member 16. The handle 22 cooperates with the releasable support means 60 to allow the user to separate the handle 22 from the support structure 14. As has been illustrated in FIGS. 4 and 6, a preferred embodiment of the roller support frame 12 includes a stud 62 which extends through the roller support member 32 and cooperates with a wing-nut 64 or other tightening means to allow positioning of the roller support frame 12 against the roller support member 32. It is contemplated that the stud 62, or other engagement means, will cooperate with the handle 22, so that the handle 22 accepts the stud 22.

Thus it will be appreciated that the disclosed structure allows the use of the handle 22 together with the roller support structure 14. Furthermore, by using a releasable support means 60 to attach the handle 22 to the roller support structure 14, and using an attachment on the roller support frame 12 which cooperates with the handle 22 to allow the handle 22 to be attached directly to the roller support frame 12, one produces a versatile tool with versatility that could not be achieved with known devices.

Additionally, it is important to note that the means 44 for selectively adjusting the position of the roller support structure 14 may be incorporated into the various embodiments shown here. For example, in the embodiment illustrated in FIGS. 5 and 6 the releasable support means 60 may include a stud with a splined shank, or a shank with a patterned perimeter, mounted on the elongate member 16 and a similar stud mounted on the roller support frame 12 in place of the illustrated stud 62. The perimeter of the stud would cooperate with an opposite pattern incorporated into the roller support 32.

It is also important to note that it is contemplated that various devices may be used as a releasable support means 60. For example, a quick releasable connector, such as a ball and releasable track mechanism, as typically used to provide quick connect and disconnect of air hoses or similar components where a male portion and a female portion are held together by means of a releasable protrusion, or other quick release mechanism.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A roller support structure comprising:

an elongate member having a first end, a mid-portion, and a second end;

a roller support extending from the first end of the elongate member and at a substantially right angle to said elongate member;

a detachable handle extending from the mid-portion of the elongate member, said handle being at a substantially right angle to the elongate member;

a forearm engagement member, said forearm engagement member extending from the second end of said elongate member and a substantially right angle to the elongate member;

a roller support frame having a substantially horizontal member and a roller support axis, the horizontal member being substantially parallel the roller support axis; and means for selectively retaining the horizontal member against the roller support member at a desired angle to the roller support member, said means for selectively retaining the horizontal member against the roller support member having means for attaching the horizontal member to said handle, so that the angle of the roller support axis relative to the roller support member may be varied, and so that said handle attaches to said roller support frame.

2. A roller support structure according to claim 1 wherein said roller support member further comprises a surface having engagement means, and said horizontal member further comprises engagement means for cooperating with the engagement means on said roller support member, so that the angle of said horizontal member relative to said roller support member may be varied.

3. A roller support structure according to claim 2 wherein said roller support member and said handle are substantially parallel to one another.

4. A roller support structure according to claim 3 wherein said engagement means on said roller support member comprises a surface having a plurality of radially extending recesses, and said engagement means on said horizontal member further comprises a plurality of radially extending protrusions for cooperating with the engagement means on said roller support member.

5. A roller support structure according to claim 4 wherein said engagement means on said roller support member and said engagement means on said horizontal member are held against one another by means of a releasable fastener.

6. A roller support structure according to claim 5 wherein said forearm engagement member comprises a generally arcuate section adapted for accepting the user's forearm and adjustable belt means for securing the user's forearm to the arcuate section.

7. A hand tool for providing pressure by means of a roller, the tool comprising:

a roller support structure comprising:

an elongate member having a first end, a mid-portion, and a second end;

a roller support extending from the first end of the elongate member and at a substantially right angle to said elongate member;

an elongated handle extending from the mid-portion of the elongate member, said handle being releasably attached at a substantially right angle to the elongate member by a means for releasably attaching said handle;

a forearm engagement member, said forearm engagement member extending from the second end of said elongate member and at a substantially right angle to the elongate member, said forearm engagement member comprising a generally arcuate section adapted for accepting the user's forearm;

a roller support frame having a substantially horizontal member and a roller support axis, the horizontal member being substantially parallel the roller support axis;

and means for selectively retaining the horizontal member against the roller support member and at an angle to the roller support member, said means for selectively retaining the horizontal member against the roller support member having means for attaching the horizontal member to said handle, so that the angle of the roller support axis relative to the roller support member may be varied and so that said roller support frame is selectively directly attachable to said handle.

8. A hand tool according to claim 7 wherein said roller support member further comprises a surface having engagement means, and said horizontal member further comprises engagement means for cooperating with the engagement means on said roller support member, so that the angle of said horizontal member relative to said roller support member may be varied.

9. A hand tool according to claim 7 wherein said roller support member and said handle are substantially parallel to one another.

10. A hand tool according to claim 8 wherein said engagement means on said roller support member comprises a surface having a plurality of radially extending recesses, and said engagement means on said horizontal member further comprises a plurality of radially extending protrusions for cooperating with the engagement means on said roller support member.

11. A hand tool according to claim 7 wherein said engagement means on said roller support member and said engagement means on said horizontal member are held against one another by means of a releasable fastener.

12. An adjustable roller tool comprising:

a roller support frame comprising:

a substantially horizontal member and a roller support axis, the horizontal member being substantially parallel to the roller support axis;

a roller support structure comprising:

an elongate member having a first end, a mid-portion, and a second end;

an elongated handle extending from the mid-portion of the elongate member, said handle) being attached to the elongate member at a substantially right angle to the elongate member;

a forearm engagement member, said forearm engagement member extending from the second end of said elongate member and at a substantially right angle to the elongate member for accepting the user's forearm;

a roller support extending from the first end of the elongate member;

means for selectively positioning said roller support member against said substantially horizontal member at an angle to one another, so that the angle of the roller support axis relative to the roller support member may be varied.

13. An adjustable roller tool according to claim 12 wherein said means for selectively positioning said roller support member against said substantially horizontal member comprises:

a first surface having engagement means, said first surface being mounted on said roller support member;

a second surface having engagement means adapted for cooperating with the engagement means of said first surface, said second surface being mounted on said horizontal member of said roller support frame.

14. An adjustable roller tool according to claim 13 and further comprising means for selectively retaining said first surface against said second surface.

15. An adjustable roller tool according to claim 14 and further comprising said forearm engagement member further comprises strap means for retaining a user's forearm against the arcuate section.

16. A hand tool according to claim 15 wherein said means for selectively retaining said first surface against said second surface comprises a releasable fastener.

* * * * *